US012392199B2

(12) United States Patent
Grimes et al.

(10) Patent No.: US 12,392,199 B2
(45) Date of Patent: Aug. 19, 2025

(54) EARTH-BORING TOOL GEOMETRY AND ASSOCIATED APPARATUS AND METHODS

(71) Applicant: Baker Hughes Oilfield Operations LLC, Houston, TX (US)

(72) Inventors: Robert E. Grimes, Houston, TX (US); Nathan S. Lockwood, Conroe, TX (US)

( * ) Notice: Subject to any disclaimer, the term of this patent is extended or adjusted under 35 U.S.C. 154(b) by 24 days.

(21) Appl. No.: 18/191,587

(22) Filed: Mar. 28, 2023

(65) Prior Publication Data

US 2024/0328259 A1 Oct. 3, 2024

(51) Int. Cl.
*E21B 10/16* (2006.01)
*E21B 10/14* (2006.01)

(52) U.S. Cl.
CPC ..... *E21B 10/14* (2013.01); *E21B 10/16* (2013.01)

(58) Field of Classification Search
CPC ..... E21B 10/14
See application file for complete search history.

(56) References Cited

U.S. PATENT DOCUMENTS 1,762,570 A * 6/1930 Behnke ..... E21B 10/10 175/366
1,778,966 A * 10/1930 Stokes ..... E21B 4/006 175/372
1,792,927 A * 2/1931 Reed ..... E21B 10/10 175/364
2,107,626 A * 2/1938 Catland ..... E21B 10/10 175/376
2,639,896 A * 5/1953 Francis ..... E21B 10/08 175/372
2,901,223 A * 8/1959 Scott ..... E21B 10/08 175/336
3,250,337 A * 5/1966 Demo ..... E21B 10/04 175/374
4,006,788 A * 2/1977 Garner ..... E21B 10/14 175/336
4,343,371 A * 8/1982 Baker, III ..... E21B 10/5673 175/336

(Continued)

FOREIGN PATENT DOCUMENTS

WO 2015/191028 A1 2/2020
WO WO-2024054231 A1 * 3/2024

OTHER PUBLICATIONS

Lockwood, Nathan S., International Application No. PCT/US2022/076118 titled Earth-Boring Tool Geometry and Cutter Placement and Associated Apparatus and Methods, filed Sep. 8, 2022.

(Continued)

*Primary Examiner* — Blake Michener
(74) *Attorney, Agent, or Firm* — Baker Hughes Company

(57) ABSTRACT

An earth-boring tool may include a tool body, at least one blade, and a roller cone pocket defined in the tool body adjacent the at least one blade. A surface of the roller cone pocket may define at least one protruding ridge. The earth-boring tool may further include a roller cone assembly disposed in the pocket. The roller cone assembly may include a plurality of inserts or teeth extending from a surface of the roller cone assembly. The at least one protruding ridge is located between longitudinally adjacent inserts or teeth.

18 Claims, 8 Drawing Sheets

(56) References Cited

U.S. PATENT DOCUMENTS

| | | | | |
|---|---|---|---|---|
| 4,359,112 | A * | 11/1982 | Garner | E21B 10/04 175/428 |
| 5,695,019 | A * | 12/1997 | Shamburger, Jr. | E21B 10/52 175/426 |
| 6,450,271 | B1 * | 9/2002 | Tibbitts | E21B 10/567 175/425 |
| 6,561,292 | B1 | 5/2003 | Portwood | |
| 2011/0079444 | A1 * | 4/2011 | Kulkarni | E21B 10/22 175/428 |
| 2011/0162893 | A1 | 7/2011 | Zhang | |
| 2017/0167201 | A1 * | 6/2017 | Clausen | E21B 10/20 |
| 2020/0047253 | A1 | 2/2020 | Thomas et al. | |
| 2023/0374865 | A1 * | 11/2023 | McDonough | E21B 10/25 |

OTHER PUBLICATIONS

International Search Report for Application No. PCT/US2024/021495 dated Jul. 2, 2024, 3 pages.
International Written Opinion for Application No. PCT/US2024/021495 dated Jul. 2, 2024, 3 pages.

* cited by examiner

EARTH-BORING TOOL GEOMETRY AND ASSOCIATED APPARATUS AND METHODS

TECHNICAL FIELD

Embodiments of the present disclosure generally relate to earth-boring operations. In particular, embodiments of the present disclosure relate to earth-boring tool geometry and associated apparatus and methods.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. In some cases, earth-boring tools may be configured to drill through plugs (e.g., fracturing plugs, bridge plugs, cement plugs, etc.). In some cases, the plugs may include slips or other types of anchors and the earth-boring tool may be configured to drill through the plug and any slip, anchor, and other component thereof.

Earth-boring tools may include cutting structures formed from abrasive materials having high hardness characteristics. The cutting structures may be configured to engage the formations and additional elements removing material therefrom. As the cutting structures engage the formations and additional elements, debris (e.g., chips, cuttings, loose material, etc.) and significant amounts of heat may be generated. If the debris and heat are not dissipated, they may contribute to premature failure of the cutting structures requiring the earth-boring tool to be removed for repair and or replacement. This may result in significant losses of-time-time, reducing the efficiency and increasing the costs of a drilling operation.

Fixed blade drill bits include polycrystalline diamond compact (PDC) drill bits and other drag-type drill bits. These drill bits typically include a bit body having an externally threaded connection at one end for connection to a drill string, and a plurality of cutting blades extending from the opposite end of the bit body. The cutting blades form the cutting surface of the drill bit. A plurality of cutting elements, such as PDC cutters or other materials that are hard enough to deform and/or cut through earth formations, are attached to or inserted into the blades of the bit. These cutters extend from the bit and form the cutting profile of the bit. The cutting elements include polycrystalline diamond or cubic boron nitride, for example, which is formed on or bonded to a substrate, which is usually comprised of cemented tungsten carbide. The cutting elements are arranged in selected locations on the blades or other structures on the bit body with the diamond cutting elements facing generally in the direction of bit rotation. This plurality of cutting elements is used to cut through the subterranean formation during drilling operations when the drill bit is rotated by a downhole motor or a drilling rig at the surface. Fixed blade drill bits have the advantage of being much more aggressive during drilling and therefore usually drill much faster at equivalent weight-on-bit (WOB) levels than, for instance, a roller cone bit. In addition, they have no moving parts, which makes their design less complex and more robust. They also require more torque to rotate during drilling. During a drilling operation, fixed blade drill bits are rotated against a formation being drilled under applied weight-on-bit to remove formation material. The cutting elements on the fixed blade drill bits are continuously engaged as they scrape material from the formation, while in a roller cone drill bit, the cutting elements on each roller cone indent and crush the formation intermittently with little or no relative scraping motion between the cutting element and the formation.

Roller cone bits are earth boring drill bits that are known as a durable tool for drilling hard and abrasive formations. The roller cone type of drill bit typically includes a bit body with an externally threaded connection at one end, and a plurality of circumferentially spaced roller cones (typically three) attached at an offset angle to the longitudinal axis of the drill bit at the other end of the drill bit. These roller cones are rotatable about bearings and rotate individually with respect to the bit body. The bit is secured to the lower end of a drill string that is rotated from the surface or by downhole motors or turbines. The roller cones mounted on the bit roll and slide upon the bottom and sides of the borehole as the drill string is rotated, engaging and disintegrating the formation material to be removed. The roller cones are provided with inserts mounted in pockets of the cone or teeth integral with the cone that are forced to penetrate and gouge the bottom of the borehole by rotation of the drill string in combination with weight from the drill string, commonly termed weight on bit (WOB). The cuttings from the bottom and sides of the borehole are washed away and disposed of by a drilling fluid. The drilling fluid is pumped down from the surface through the hollow, rotating drill string, and then through the nozzles (orifices) on the drill bit. Eventually, the cuttings are carried away in the drilling fluid to the surface up the exterior of the drill string in an annulus between the drill string and a wall of the borehole.

A relatively new type of drill bit has emerged in the drilling arena, and it is known as the "hybrid" drill bit. This drill bit combines both fixed cutting blades and rolling cones on its working face. The hybrid drill bit is designed to overcome some of the limiting characteristics of the roller cone and fixed cutter drill bits, such as balling, reducing drilling efficiency, tracking, and wearing. PDC fixed cutter bits have replaced roller cone bits in many applications. However, roller cone bits are uniquely situated for applications involving hard, abrasive, and interbedded formations, as well as for complex directional drilling applications and applications involving high torque requirements. In these applications, hybrid drill bits can substantially enhance the performance of a roller cone bit with fewer limitations compared to a conventional PDC bit.

BRIEF SUMMARY

Embodiments of the present disclosure may include an earth-boring tool. The earth-boring tool may include a tool body, at least one blade, and a roller cone pocket defined in the tool body adjacent the at least one blade, a surface of the roller cone pocket defining at least one protruding ridge. The earth-boring tool may also include a roller cone assembly disposed in the pocket, the roller cone assembly including a plurality of cutting elements extending from a surface of the roller cone assembly.

Another embodiment of the present disclosure may include a method of forming an earth-boring tool. The method may include forming a tool body comprising at least one blade and a pocket defined in the tool body adjacent to the at least one blade, a surface of the pocket defining at least one ridge, and disposing a roller cone assembly into the pocket, wherein the at least one ridge is positioned between at least two cutting elements from the roller cone assembly.

Another embodiment of the disclosure may include an earth-boring tool. The earth-boring tool may include a roller cone assembly configured to rotate relative to a tool body of the earth-boring tool about a longitudinal axis of the roller cone assembly. The earth-boring tool may also include one or more ridges extending from the tool body toward a surface of the roller cone assembly, the one or more ridges configured to break up debris or prevent debris from forming in a region between the roller cone assembly and the tool body.

BRIEF DESCRIPTION OF THE SEVERAL VIEWS OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
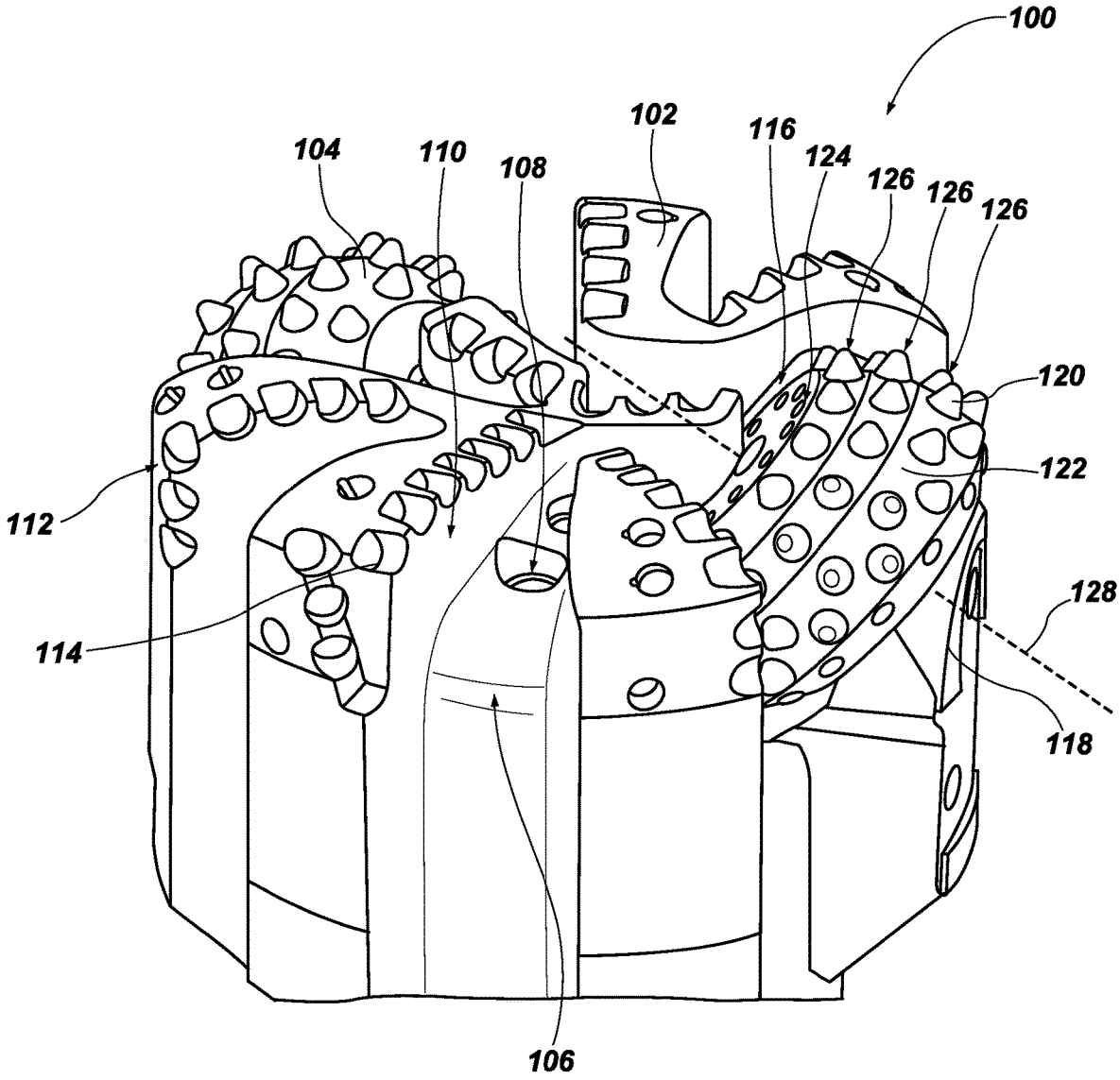
FIG. 1 illustrates an embodiment of an earth-boring tool according to one or more embodiments of the present disclosure.

"Hybrid" drill bits are designed to combine both fixed cutting blades and rolling cones on the working face to overcome some of the limiting characteristics of roller cone and fixed cutter drill bits, such as balling, reducing drilling efficiency, tracking, and wearing. However, in conventional hybrid drill bits, the roller cones may have a minimal amount of clearance (e.g., less than 0.100") from the bit body due to spacing constraints or blade integrity concerns. Because of this, cuttings may accumulate at the tops of the roller cones or between rows of inserts or teeth carried on a surface of the roller cones. This problem is exacerbated by some conventional bit frames that make using water-based drilling fluids to clean the hybrid drill bits more difficult. For example, roller cones, in particular, may be susceptible to balling in certain types of shale/clay formations, resulting in reduced cutting effectiveness and a lower rate of penetration (ROP). Moreover, as cuttings ball on the roller cones, the cuttings may begin to be packed in areas of the bit body (e.g., areas of a roller cone pocket in which a roller cone assembly is carried) that may cause reduction in effective compact projection or may cause abrasion and damage to the bit body. Furthermore, higher density placement of inserts or teeth on the surface of the roller cones accentuates these tendencies.

Accordingly, to prevent balling and the problems caused thereby, some embodiments of the present disclosure include an earth-boring tool having both blades and rotatable structures (e.g., roller cones) and a surface of the earth-boring tool configured to reduce the accumulation of cuttings on the rotatable structures. In particular, the earth-boring tool may include a roller cone pocket configured to receive a roller cone where a surface of the roller cone pocket defines one or more protruding ridges that intermesh with one or more inserts or teeth carried on the roller cone. For example, the roller cone may include rings of inserts or teeth extending circumferentially around a surface of the roller cone and substantially perpendicular to an axis of rotation (e.g., a center longitudinal axis) of the roller cone where the one or more protruding ridges may extend such that a ridge of the one or more protruding ridges extends toward a surface of the roller cone between two adjacent rings of inserts or teeth of the roller cone. The one or more ridges may remove cuttings and other debris or prevent cuttings and debris from packing between two or more inserts or teeth of the roller cones as the cones rotate, preventing reduced bit performance by clearing of the debris as well as bit damage. By preventing bit damage, the working life of the bit body of the earth-boring tool may be increased, and the bit body may require fewer expensive repairs throughout its lifespan. Additionally, the increased lifespan reduces the frequency of needing to replace the drill bit, saving additional cost over time.

The FIG. 1 illustrates an embodiment of an earth-boring tool 100 configured as a hybrid bit. The earth-boring tool 100 may include one or more blades 102 arranged about the body of the earth-boring tool 100. The earth-boring tool 100 may also include one or more roller cone assemblies 104 (e.g., roller cones). Blades 102 may be separated by junk slots 106. The junk slots 106 may include nozzles 108. The nozzles 108 may be configured to supply a fluid (e.g., discharge a fluid), such as water, drilling mud, etc., into the junk slots 106 and/or around the roller cone assemblies 104.

The blades 102 may each include a face 110 and a shoulder region 112. The face 110 may be oriented to face the area ahead of the blade 102 in a direction of bit rotation and the shoulder region 112 may transition from the outer extent of the face 110 to the radially outer region of the blade 102. The blade 102 may include multiple cutter pockets 114 formed along an edge of the face 110 of the blade 102. The cutter pockets 114 may be configured to receive shear-type cutting elements, such as polycrystalline diamond compact (PDC) cutting elements. The cutting elements may be arranged such that cutting faces of the cutting elements face in the direction of bit rotation as the face 110 of the blade 102 and back raked from the plane of the face 110. The fluid flowing from the nozzles 108 may be configured to clear debris and formation materials away from the cutting elements and face 110 of the blade 102 into junk slots 106 as well as cooling the cutting elements.

The earth-boring tool 100 may also include one or more roller cone pockets 116 defined in the tool body of the earth-boring tool 100 between at least two of the blades 102. The roller cone pockets 116 may each be configured to receive one of the roller cone assemblies 104. Each of the roller cone assemblies 104 may be rotatably secured to an arm 118 extending from the earth-boring tool 100. Each of the arms 118 may be substantially aligned with an associated roller cone pocket 116. The arms 118 may position the roller cone assemblies 104, such that the roller cone assemblies 104 may rotate freely about a longitudinal axis 128 of the respective roller cone assemblies 104. The roller cone pocket 116 may have an inside diameter greater than an outer diameter of the associated roller cone assembly 104, such that the associated roller cone assembly 104 may rotate within the roller cone pocket 116 without contacting walls of the roller cone pocket 116.

The roller cone assemblies 104 may include elements in the form of inserts or teeth 120 extending from a surface 122 of the roller cone assemblies 104. The inserts or teeth 120 may be arranged in rings 126 about the respective roller cone assemblies 104, such that each insert or tooth 120 in a ring 126 is substantially a same distance from a face 124 of the associated roller cone assembly 104. Each of the rings 126 may be positioned a different distance from the face 124 of the associated roller cone assembly 104 along longitudinal axis 128 of arm 118 carrying the roller cone assembly 104. The inserts or teeth 120 may be configured to engage a formation when the earth-boring tool 100 is deployed. The inserts or teeth 120 may break material from the formation as the roller cone assemblies 104 rotate within the earth-boring tool 100. The cutting elements secured to the blades 102 may be configured to then remove the material broken away from the formation by the inserts or teeth 120 of the roller cone assemblies 104 as well as shear formation material not engaged by inserts or teeth 120 of the roller cone assembly rotationally preceding a respective blade 102. The formation materials may be cleared from the blades 102 by the fluid flowing from the nozzles 108 as described above. However, in some cases, portions of the formation material may be captured by the inserts or teeth 120 of the roller cone assemblies 104. The formation material may be trapped between the roller cone assemblies 104 and surfaces of the earth-boring tool 100 in the roller cone pocket 116, which may create excess friction between walls of the roller cone pocket 116 and the roller cone assembly 104. The excess friction may increase wear on the inserts or teeth 120 of the roller cone assembly 104 and/or may substantially prevent the roller cone assembly 104 from rotating relative to the earth-boring tool 100, which may reduce the benefits of the roller cone assembly 104 over the stationary cutting elements coupled to the blades 102. The increased wear and friction caused by the formation material trapped between the roller cone assemblies 104 and surfaces of the earth-boring tool 100 may also wear away the surfaces 122 of the roller cone assemblies 104. As the surfaces 122 of the roller cone assemblies 104 are worn away inserts or teeth 120 carried in pockets of a roller cone may loosen and/or fall out of the roller cone assembly 104. In some instances, formation material trapped between roller cone assemblies 104 and surfaces of the earth-boring tool 100 in the roller cone pockets 116 may also reduce the effective exposure of the inserts or teeth 120. Reducing the effective exposure of the inserts or teeth 120 may reduce a potential rate of penetration of the earth-boring tool 100.

Figure 2:
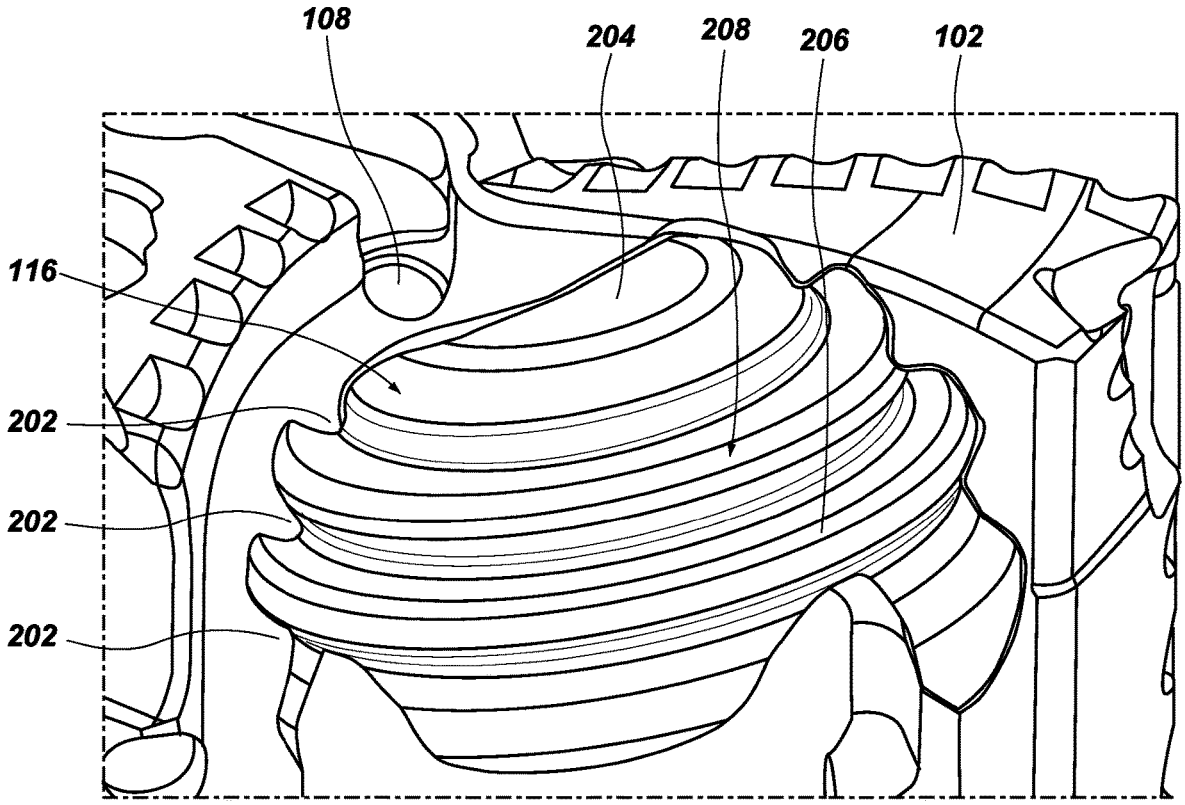
FIG. 2 illustrates the earth-boring tool with the roller cone assembly removed to illustrate features of the roller cone pocket, according to one or more embodiments of the present disclosure.

FIG. 2 illustrates the earth-boring tool 100 with the roller cone assemblies 104 removed to illustrate features of the roller cone pocket 116, according to one or more embodiments of the present disclosure. The roller cone pocket 116 may include a surface 208. The roller cone pocket surface 208 may include a face surface 204 and a side surface 206. The face surface 204 may be positioned proximate a center of the earth-boring tool 100 and configured to be substantially complimentary to the face 124 of the roller cone assembly 104. The side surface 206 may be a curved surface substantially complimentary to the surface 122 of the roller cone assembly 104. The curved surface of the side surface 206 may have a major dimension (e.g., radius or diameter) greater than a major dimension of the roller cone assembly 104 such that the roller cone assembly 104 and the inserts or teeth 120 thereof may rotate within the roller cone pocket 116 during operation of the earth-boring tool 100 without contacting the side surface 206. At least one part of the side surface 206 may be formed by a blade 102 of the earth-boring tool.

The roller cone pocket surface 208 may define ridges 202 that extend generally radially inward from the roller cone pocket surface 208. The ridges 202 may also extend at least partially across the roller cone pocket surface 208. For example, the ridges 202 may form one or more continuous ridges that extend across the roller cone pocket surface 208 at least substantially perpendicular to the longitudinal axis 128 of the roller cone assembly 104 when the roller cone assembly 104 is disposed within the roller cone pocket 116. The one or more ridges may be positioned or spaced on the side surface 206 in positions substantially offset from the rings 126 of the inserts or teeth 120 of the roller cone assembly 104, as described in further detail below in regard to FIG. 3A and FIG. 3B. For example, the one or more ridges 202 may be positioned such that each ridge of the one or more ridges 202 is positioned between the rings 126 of inserts or teeth 120 of the associated roller cone assembly 104. Stated another way, the ridges 202 may be positioned such that the one or more ridges 202 extend toward the surface 122 of the roller cone assembly 104 at positions that coincide with a gap between the rings 126. In some embodiments, one or more of the ridges 202 may define one or more gaps along a length of one or more of the ridges 202 as discussed in more detail below with regard to FIG. 4. Moreover, in some embodiments the roller cone pocket surface 208 may define at least one recess located between or adjacent to the ridges 202, as discussed in more detail below with regard to FIG. 5.

In some embodiments, the ridges 202 may include one or more interface cutting elements. For example, one or more cutting elements may be disposed along a crest of at least one of the ridges 202 and extend toward the surface 122 of the roller cone assembly 104 between or adjacent to the rings 126 of inserts or teeth 120 without contacting the surface 122 or the inserts or teeth 120 of the roller cone assembly 104.

In some embodiments, the face surface 204 may include one or more ridges that extend toward a face 124 of the roller cone assembly 104. For example, the face surface 204 may define one or more ridges that may be arranged at least partially circumferentially about the longitudinal axis 128 of the roller cone assembly 104 when the roller cone assembly 104 is disposed in the roller cone pocket 116. The face 124 of the roller cone assembly 104 may be substantially free of inserts or teeth 120 such that the face 124 of the roller cone assembly 104 may be substantially planar.

Figure 3A:
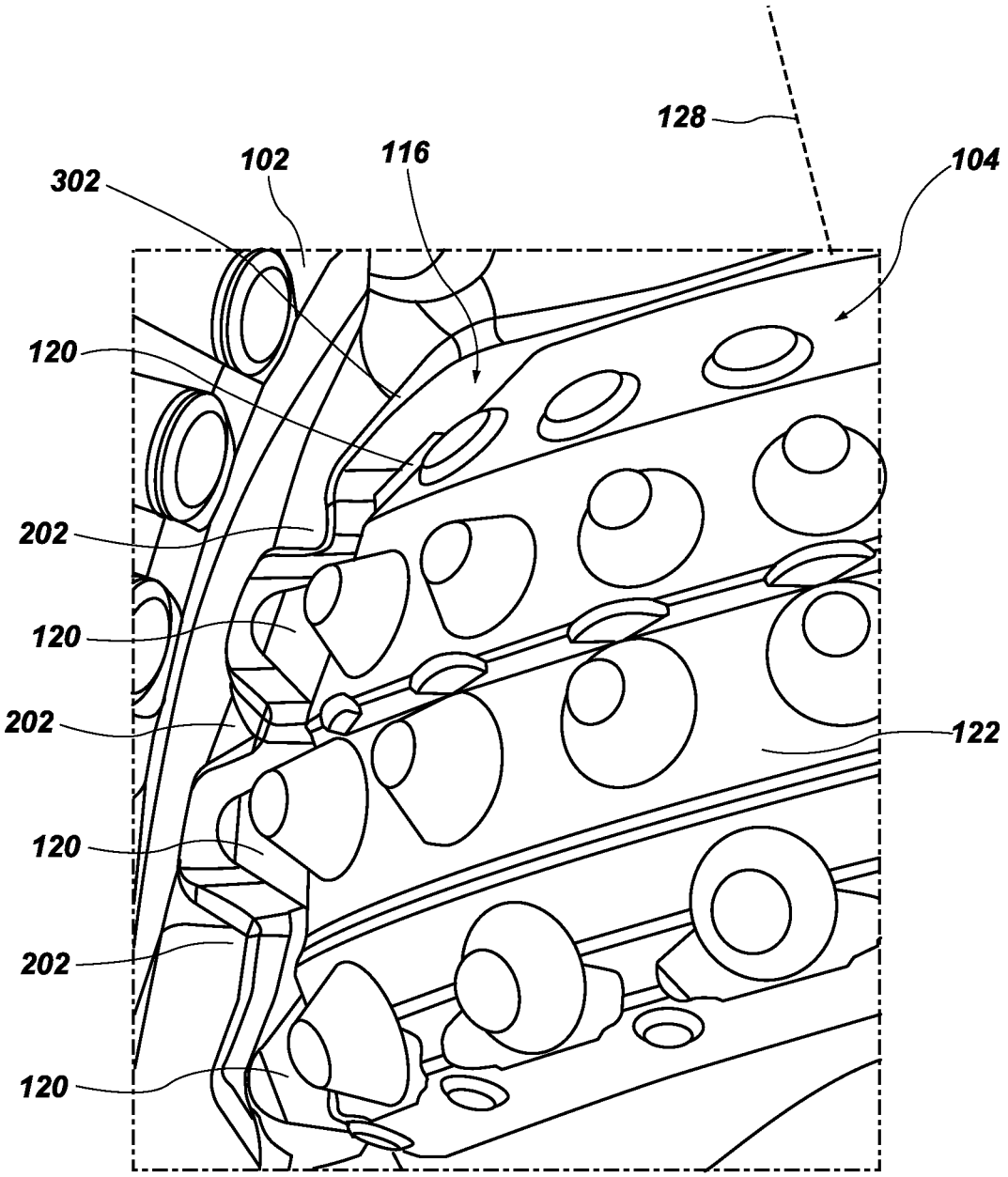
FIG. 3A shows an enlarged view of a roller cone assembly disposed within the roller cone pocket, according to one or more embodiments of the present disclosure.
Figure 3B:
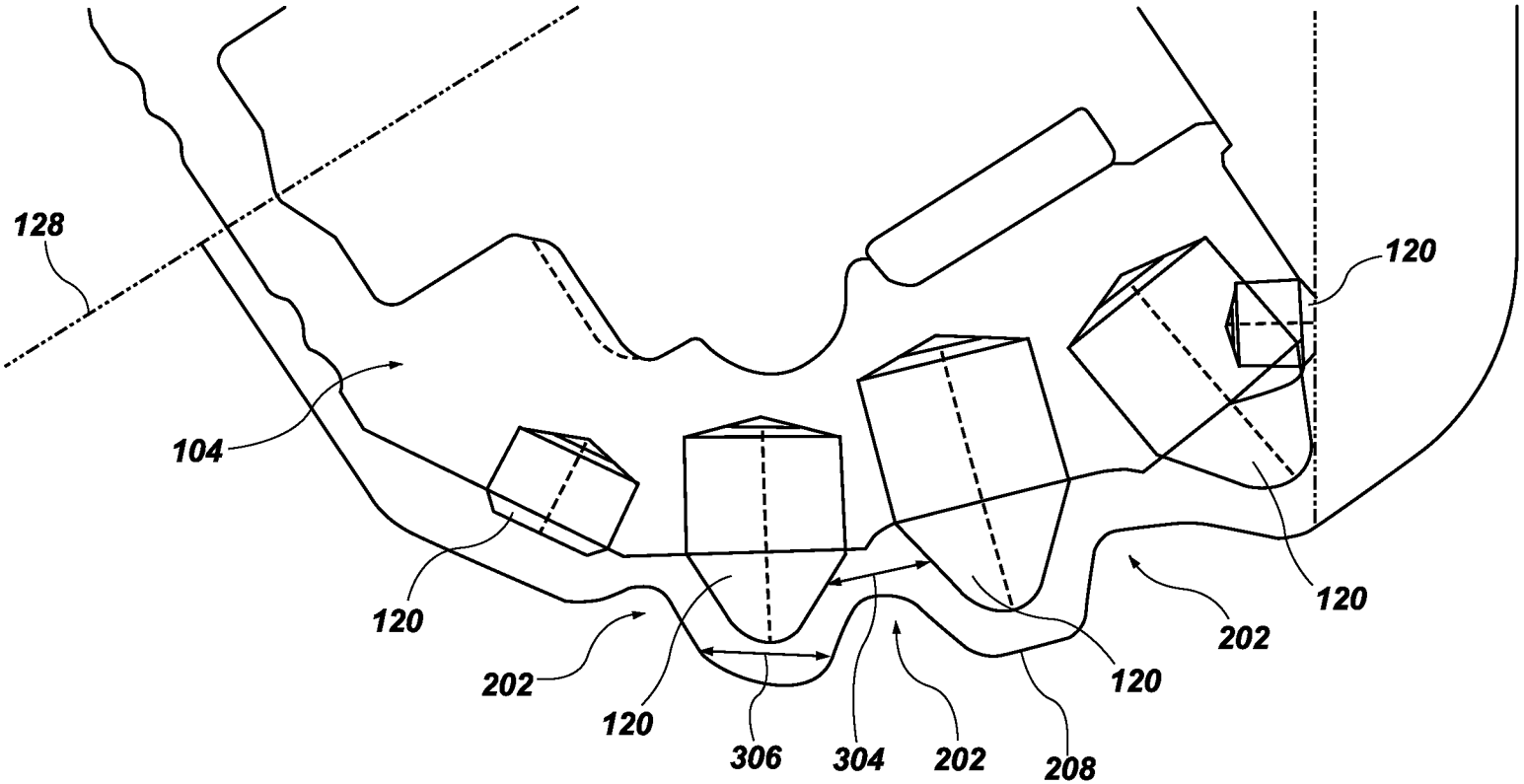
FIG. 3B shows a schematic cross-section of a roller cone assembly disposed within the roller cone pocket, according to one or more embodiments of the present disclosure.

FIG. 3A shows an enlarged view of a roller cone assembly 104 disposed within the roller cone pocket 116, according to one or more embodiments of the present disclosure. FIG. 3B shows a schematic cross-section of a roller cone assembly 104 disposed within the roller cone pocket 116, according to one or more embodiments of the present disclosure. Referring to both FIG. 3A and FIG. 3B together, in some embodiments a cross-section profile of the ridges 202 may be generally conically shaped, as illustrated in FIG. 3A and FIG. 3B. Furthermore, the profile of the ridges 202 may exhibit an asymmetrical shape. For example, as illustrated in FIG. 3A and FIG. 3B, the ridges 202 may be shaped such that the ridges 202 may exhibit varying slopes over a surface of the ridges 202. Furthermore, a crest of the profile of the ridges 202 may be off-center. For example, a crest of the profile of the ridges 202 at a given point along the length of the ridges 202 may be offset from a center longitudinal axis of the ridge profile. In some embodiments, the cross-sectional profile of the ridges 202 at a given point along the length of the ridges may be shaped generally triangular, square, as a semicircle, elliptical, or irregular. Though discussed as specific shapes, one of ordinary skill in the art that the shape of cross-sectional profile of the ridges 202 at a point along the length of the ridges 202 may comprise any shape so long that the ridges 202 are shaped to compliment a cutting path of the inserts or teeth 120 of the roller cone assembly 104 during operation of the earth-boring tool 100.

Furthermore, the profile of each of the ridges 202 may vary as the ridges 202 extend across the roller cone pocket surface 208. For example, the ridges 202 may vary in height (e.g., the distance from a plane defined by the roller cone pocket surface 208 at the base of the ridges 202), width, crest position (e.g., the crest of a profile of a ridge 202 relative to a longitudinal axis of the profile of the ridge 202), slope (e.g., across a surface of a ridge of the ridges 202), or cross-sectional profile shape as the ridges 202 extend across the roller cone pocket surface 208. The ridges 202 may extend from a leading edge 302 of the roller cone pocket 116, across the roller cone pocket surface 208, as shown in FIG. 3A. For example, the ridges 202 may extend from leading edge 302 to an opposite leading edge of the roller cone pocket 116 relative to the longitudinal axis 128.

The ridges 202 may be arranged such that there is a longitudinal space 306 between adjacent ridges 202, as illustrated in FIG. 3B. The longitudinal spaces 306 may be arranged to substantially coincide with the inserts or teeth 120 of the roller cone assembly 104. Similarly, the ridges may be arranged such that the positions of the ridges 202 as they extend across the surface 122 of the roller cone assembly 104 substantially coincide with the gap 304 between the inserts or teeth 120 of the roller cone assembly 104. As described above, the inserts or teeth 120 may be arranged in rings 126 (FIG. 1) about the roller cone assembly 104 such that the gaps 304 may be in substantially a same longitudinal position along the surface 122 of the roller cone assembly 104 at each angular position of the roller cone assembly 104 as the roller cone assembly 104 rotates about the longitudinal axis 128.

The arrangement of the longitudinal spaces 306 and the gaps 304 may facilitate both the ridges 202 and the inserts or teeth 120 to pass into a plane of the opposing ridges 202 and inserts or teeth 120 without contacting the opposing ridges 202 and inserts or teeth 120. Debris caught in the inserts or teeth 120 may span the gap 304 between the inserts or teeth 120. Thus, as the roller cone assembly 104 rotates about the longitudinal axis 128, the debris spanning the gap 304 between the one or more inserts or teeth 120 may contact one or more of the ridges 202 positioned within the gaps 304 (e.g., at leading edge 302) such that the debris may be broken up through the interface between the ridges 202 and the inserts or teeth 120. For example, the ridges 202 and rotating inserts or teeth 120 may combine to form a scissor-like engagement (e.g., at leading edge 302) that may break up the debris caught in the inserts or teeth 120 of the roller cone assembly 104. Moreover, as the ridges 202 extend across the roller cone pocket surface 208 and extend into the gap 304, the ridges 202 may prevent debris from forming in the gap 304 as debris enters into the space between the roller cone assembly 104 and the roller cone pocket surface 208 during operation of the earth-boring tool 100.

In some embodiments, the roller cone pocket surface 208 may define more than one ridge extending toward surface 122 of the roller cone assembly 104 between two of the inserts or teeth 120. As a specific non-limiting example, the roller cone pocket surface 208 may define two ridges that extend toward surface 122 of the roller cone assembly 104 at a position that coincides with a gap (e.g., gap 304) between two rings (e.g., rings 126 of FIG. 1) of inserts or teeth 120 of the roller cone assembly 104 without contacting the inserts or teeth 120 or the surface 122.

In some embodiments, the ridges 202 may be formed with a body of the earth-boring tool 100. For example, the ridges 202 may be machined into a pre-formed bit body. For example, a roller cone pocket surface of a preformed bit body may be machined (e.g., have material taken away through various machining processes) into a bit body to define the ridges 202. Furthermore, after the body of the earth-boring tool 100 has been formed, a roller cone assembly 104 may be disposed into a roller cone pocket 116 defined by the body such that a first ring of the inserts or teeth 120 comprising a first formation engaging structure of at least two formation engaging structures is positioned on a first side of at least one ridge 202 and a second ring of inserts or teeth 120 comprising a second formation engaging structure of the at least two formation engaging structures is positioned on a second opposite side of the at least one ridge. When the roller cone assembly 104 is disposed within a roller cone pocket 116 of the body, the roller cone assembly may be rotatably coupled to an arm extending into the pocket.

Figure 4:
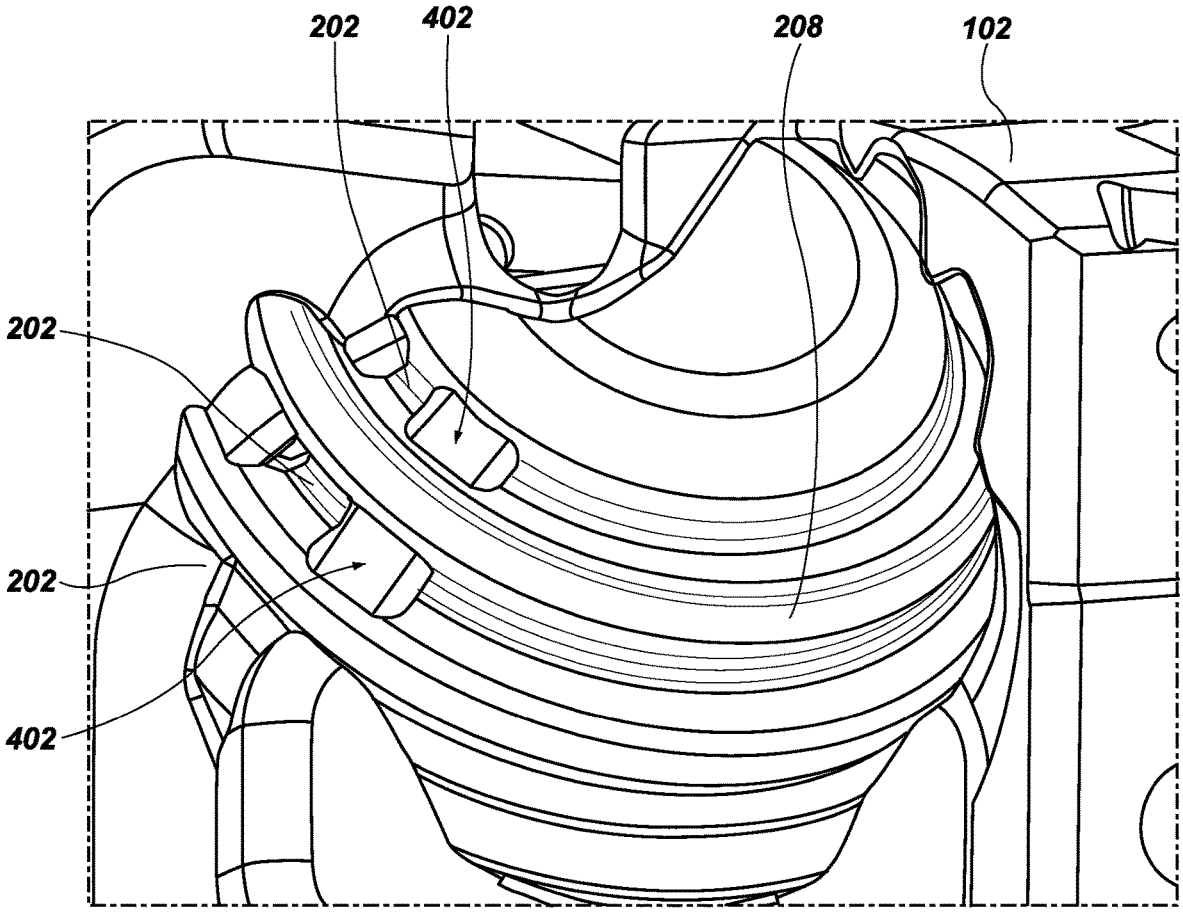
FIG. 4 illustrates an enlarged view of a roller cone pocket with ridges defining gaps or interrupted cuts along the length of the ridges, according to one or more embodiments of the present disclosure.

The ridges 202 may define one or more gaps (e.g., gaps 402) along a length of the ridges 202, as illustrated in FIG. 4. For example, gaps 402 may define an area along the length of the ridges 202 where the height of the ridges 202 is at least partially reduced. For example, the gaps 402 may define an area along the ridges 202 where the height of a ridge 202 is reduced to be flush with a plane defined by the roller cone pocket surface 208 at the base of the ridges 202. In some embodiments, sides of the ridges 202 that define the gaps 402 may be substantially perpendicular to the plane defined by the roller cone pocket surface 208 at the base of the ridges 202. In other embodiments, the sides of the ridges 202 that define the gaps 402 may be sloped relative to the plane defined by the roller cone pocket surface 208 at the base of the ridges 202.

The arrangement of the gaps 402 along the length of the ridges 202 may facilitate the flow of debris through the area between the roller cone assembly 104 and the roller cone pocket surface 208. For example, in operation as the roller cone assembly 104 rotates about longitudinal axis 128, debris (e.g., cuttings from rock formations) may enter into the area between the roller cone assembly 104 and the roller cone pocket surface 208. The gaps 402 may allow the debris to flow such that the debris is eventually expelled from the area between the roller cone assembly 104 and the roller cone pocket surface 208, which may aid in preventing balling of the debris onto the roller cone assembly 104. Furthermore, the sides of the ridges 202 defining the gaps 402 may provide additional edges along the roller cone pocket surface 208 to combine with the rotating inserts or teeth 120 to form additional scissor-like engagements between the ridges 202 and the inserts or teeth 120 that may break up debris caught in the inserts or teeth 120 of the roller cone assembly 104.

The gaps 402 may be formed at the same time as the ridges 202. For example, as the roller cone pocket 116 is machined into the body of the earth-boring tool 100, the ridges 202 may be formed on a roller cone pocket surface. The ridges 202 may then be machined (e.g., milled) to define one or more of the gaps 402.

Figure 5:
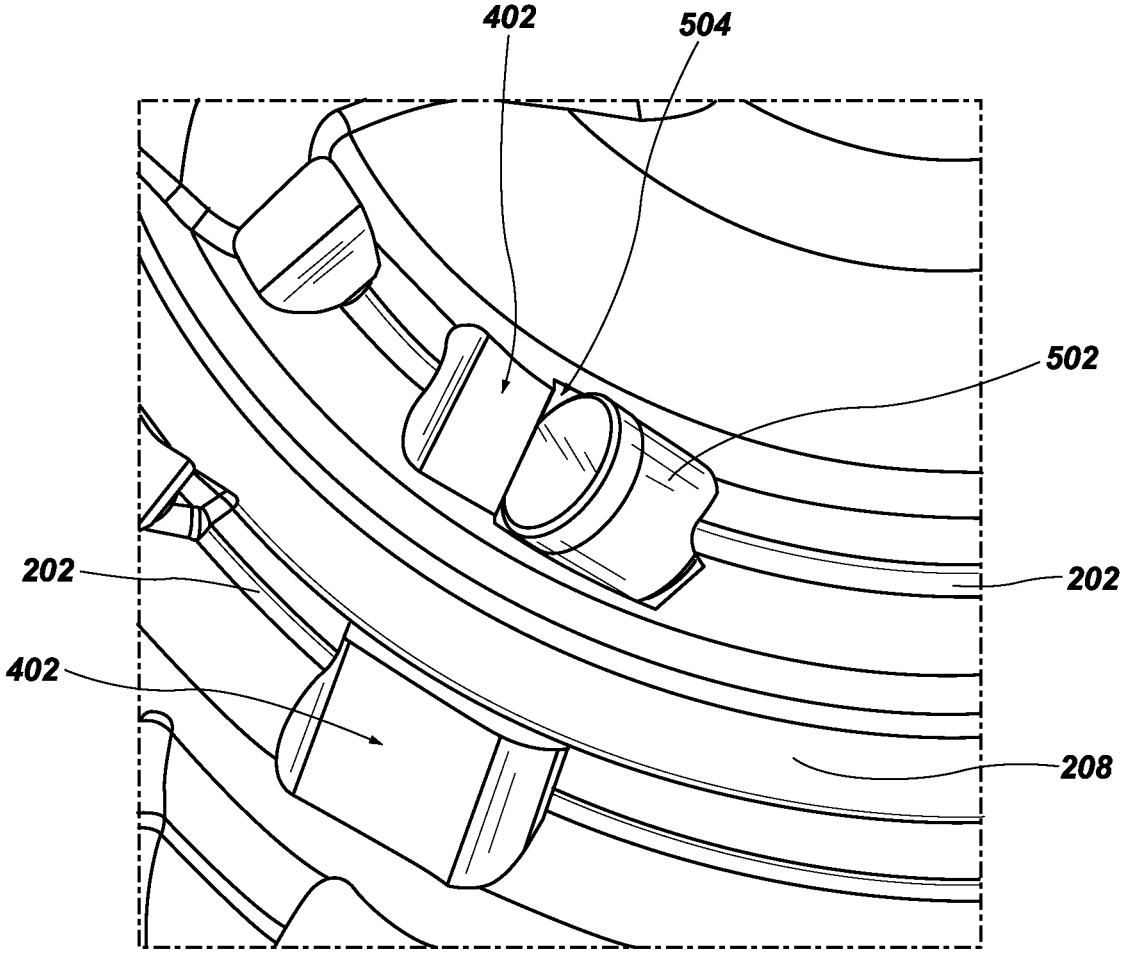
FIG. 5 illustrates an enlarged view of a cutting element disposed along the length of a ridge according to one or more embodiments of the present disclosure.

Additionally, one or more cutting elements (e.g., cutting element 502) may be embedded or positioned along a length of the ridges 202, as illustrated in FIG. 5. The cutting element may be in the form of a PDC cutting element. The cutting element 502 may be at least partially disposed within a gap 402 formed along a length of a ridge 202. For example, as shown in FIG. 5, the cutting element 502 may be positioned and oriented such that the cutting element 502 at least partially extends radially inward toward a surface 122 of the roller cone assembly 104 without contacting the surface 122 or the inserts or teeth 120 of the roller cone assembly 104. Moreover, in some embodiments the roller cone assembly may be at least partially positioned in a gap 402 along the length of a ridge 202 such that a greater area of a face of the cutting element 502 to be exposed to cuttings or debris entering into the area between the roller cone pocket surface 208 and the surface 122 of the roller cone assembly 104 during operation of the earth-boring tool 100. For example, the cutting element 502 may form a leading edge that may combine with the rotating inserts or teeth 120 to form a scissor like engagement (e.g., at the cutting element 502) that may break up the debris caught in the inserts or teeth 120. Allowing a greater surface area of the cutting element 502 to be exposed to debris during operation of the earth-boring tool 100 may allow for more effective clearing of debris caught between the inserts or teeth 120 of the roller cone assembly 104 and reduce wear of the ridge 202 while still allowing debris to flow through the gap 402 to be eventually expelled from the area between the roller cone assembly 104 and the roller cone pocket surface 208

The cutting element 502 may be positioned or spaced along a ridge 202 such that the cutting element 502 positioning is substantially offset from the rings 126 of the inserts or teeth 120 of the roller cone assembly 104. Furthermore, the cutting element 502 may be positioned such that a face of the cutting element 502 generally opposes a direction of rotation of the roller cone assembly 104. Though shown at a particular angle, the cutting element 502 may be positioned at any angle relative to the roller cone pocket surface 208 or a ridge 202 so long as the cutting element 502 is able to engage with cuttings or debris during operation of the earth-boring tool 100.

The cutting element 502 may be disposed within a cutting element pocket 504 defined along a length of a ridge 202 and within the roller cone pocket surface 208. In some embodiments, the cutting element pocket 504 may be formed at the same time as the ridges 202. Furthermore, the cutting element pocket 504 may be machined (e.g., milled) into a ridge 202 and into the roller cone pocket surface 208. In some embodiments the cutting element pocket 504 may extend into the roller cone pocket surface 208 such that the cutting element pocket 504 extends through a plane defined by the roller cone pocket surface 208. In other embodiments the cutting element pocket may be defined in a ridge 202 such that the cutting element pocket 504 does not extend into a plane defined by the roller cone pocket surface 208.

Figure 6:
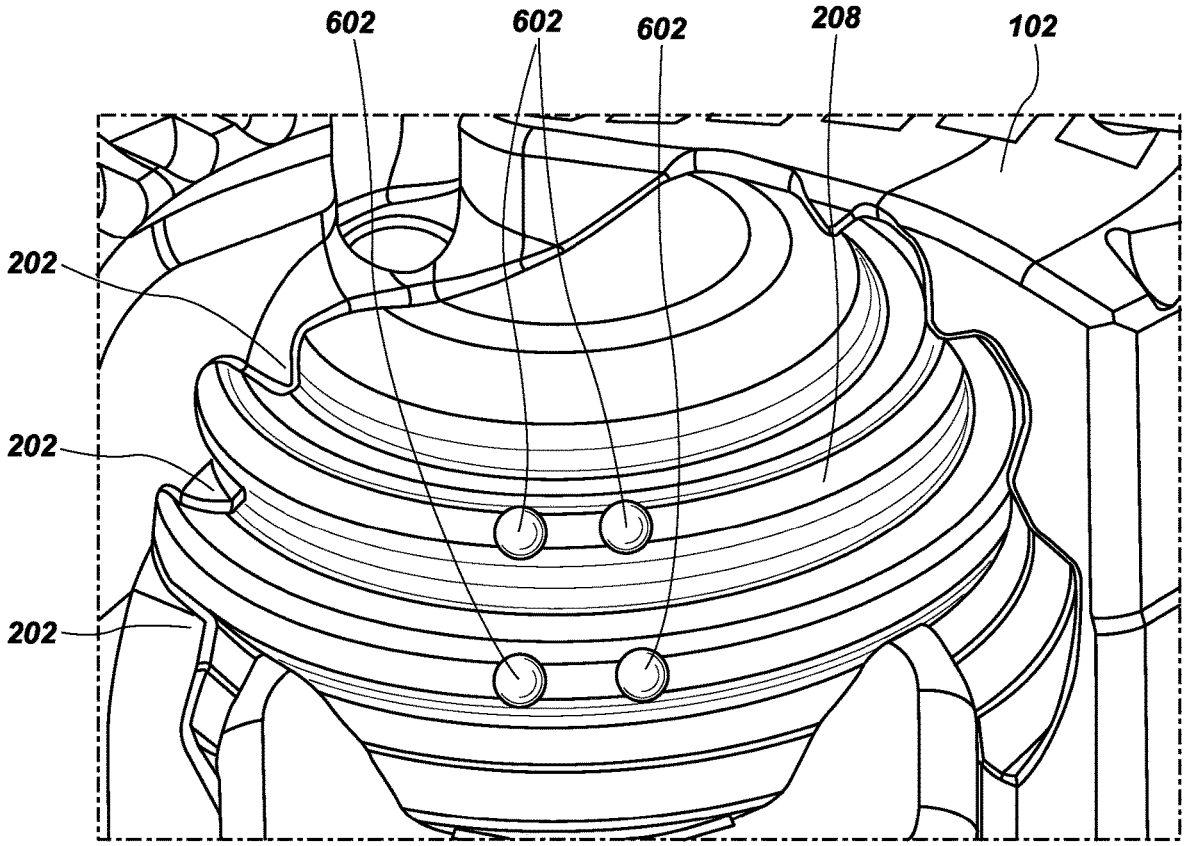
FIG. 6 illustrates an enlarged view of the roller cone pocket surface defining recesses, according to one or more embodiments of the present disclosure.

FIG. 6 illustrates an enlarged view of the roller cone pocket surface 208 defining recesses 602 positioned between or adjacent to the ridges 202, according to one or more embodiments of the present disclosure. For example, recesses 602 may be positioned between at least two of the ridges 202 such that the recesses 602 are in a trough formed by two of the ridges 202. In some embodiments the one or more recesses 602 may be configured to interface with inserts or teeth 120 of at least one formation engaging structure and help lock the roller cone assembly 104 in the roller cone pocket 116 upon seal failure, as discussed below with respect to FIG. 7. As a specific example, the recess 602 may comprise a dome shape extending into roller cone pocket surface 208. However, one of ordinary skill in the art will appreciate that any recess shape will work so long as the shape is able to interface with inserts or teeth 120 of a formation engaging structure. In some embodiments the recesses 602 may be machined (e.g., milled) into the roller cone pocket surface 208.

Figure 7:
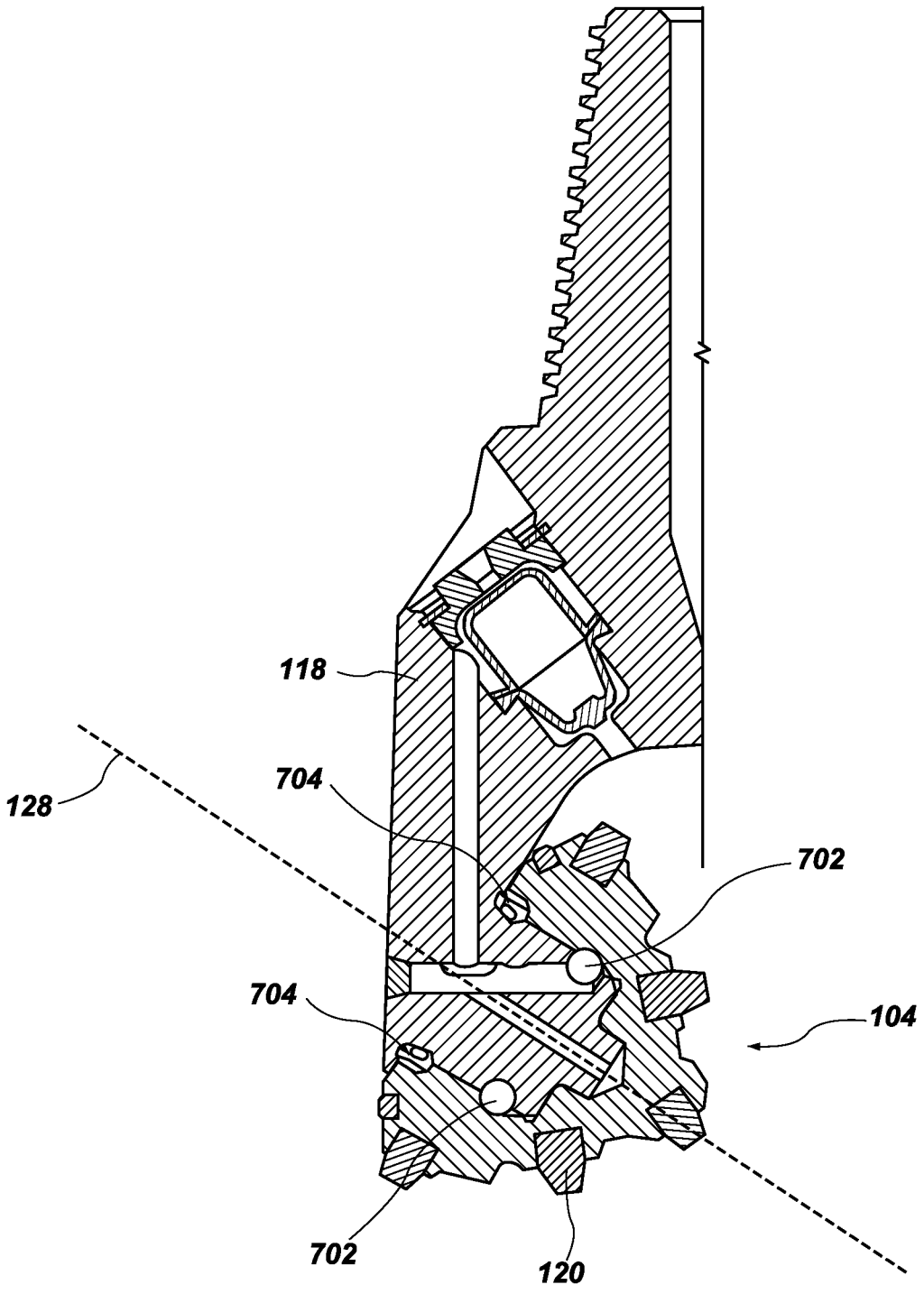
FIG. 7 is a cross-sectional side view of the roller cone assembly, according to one or more embodiments of the present disclosure.

FIG. 7 illustrates a cross-sectional side view of the roller cone assembly 104. The roller cone assembly 104 may include ball bearings 702, and a bearing seal 704. The bearing seal 704 may prevent drilling fluid and various debris from contacting the ball bearings 702 to allow smooth operation (i.e., rotation of the roller cone assembly 104). Referring to both FIG. 6 and FIG. 7 together, in operation of the earth-boring tool 100, the roller cone assembly 104 rotates about longitudinal axis 128 and is subjected to various impacts, pressures and wear from drilling into rock formations. This may lead to a failure of the bearing seal 704, thus exposing the various bearing elements including the ball bearings 702 to drilling fluid and debris, which may cause the ball bearings 702 to wear. As the ball bearings 702 wear, the roller cone assembly 104 may begin to drift inward toward the roller cone pocket surface 208 such that the inserts or teeth 120 begin to contact the roller cone pocket surface 208. When the inserts or teeth 120 contact the roller cone pocket surface 208, the recesses 602 may be positioned such that they may interface with the inserts or teeth 120 and increase the drag experienced by the roller cone assembly 104 and torque on the earth boring tool 100, which may be detected at surface thereby indicating it is time to pull the bit out of the hole.

In some embodiments the roller cone assembly 104 may include one or more sensors configured to detect the torque experienced by the roller cone assembly 104. When the detected torque of the roller cone assembly 104 surpasses a predetermined threshold, the earth-boring tool may be configured to cause an alert to be generated and sent to an operator that may indicate that the earth-boring tool 100 should be pulled out of the hole to prevent damage or loss of equipment.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bi-center bits, reamers, mills, drag bits, hybrid bits (e.g., rolling components in combination with fixed cutting elements), and other drilling bits and tools known in the art.

As used herein, the term "roller cone" means and includes a rotatable formation engaging structure mounted to an earth-boring tool and carrying inserts or teeth for gouging and crushing subterranean formation material, without regard to the specific shape of the rotatable formation engaging structure.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, terms such as ahead and behind are used in reference to a direction of movement of the associated element. For example, as a drill string moves into a borehole the bottom of the borehole is ahead of the elements of the drill string and the surface is behind the elements of the drill string. In another example, in relation to a cutting element on a rotating earth-boring tool a portion of the formation that has not yet been contacted by the cutting element is ahead of the cutting element whereas a portion of the formation that has already been contacted by the cutting element is behind the cutting element.

As used herein, the term "and/or" means and includes any and all combinations of one or more of the associated listed items.

While the present disclosure has been described herein with respect to certain illustrated examples, those of ordinary skill in the art will recognize and appreciate that the present invention is not so limited. Rather, many additions, deletions, and modifications to the illustrated and described examples may be made without departing from the scope of the invention as hereinafter claimed along with their legal equivalents. In addition, features from one example may be combined with features of another example while still being encompassed within the scope of the invention as contemplated by the inventor.

What is claimed is:

1. An earth-boring tool comprising:

a body;

at least one blade;

a roller cone pocket defined in the body adjacent the at least one blade, a surface of the roller cone pocket defining at least two fixed protruding ridges; and a roller cone assembly disposed in the roller cone pocket, the roller cone assembly including a plurality of inserts or teeth protruding from a surface of the roller cone assembly and arranged in at least three rings extending circumferentially around the surface of the roller cone assembly at least substantially about a same axis of rotation of the roller cone assembly and extending from a surface of the roller cone assembly, wherein each of the at least two protruding ridges extend toward the surface of the roller cone assembly between and into a plane of two of the at least three rings of the plurality of inserts or teeth without contacting the plurality of inserts or teeth.

2. The earth-boring tool of claim 1, wherein the at least two protruding ridge each extends toward the surface of the roller cone assembly at a position that coincides with a gap between two of the at least three rings.

3. The earth-boring tool of claim 1, wherein each of the at least two protruding ridges forms a continuous ridge across the surface of the roller cone pocket.

4. The earth-boring tool of claim 1, wherein at least one the at least two protruding ridges defines one or more gaps along a length of the at least one protruding ridge.

5. The earth-boring tool of claim 1, wherein the surface of the roller cone pocket defines at least one recess located between the at least two protruding ridges.

6. The earth-boring tool of claim 5, wherein the at least one recess comprises a dome shape extending into the surface of the roller cone pocket.

7. The earth-boring tool of claim 5, wherein the at least one recess is configured to interface with at least one cutting element of the plurality of inserts or teeth.

8. The earth-boring tool of claim 1, wherein the at least two protruding ridges extend toward a face of the roller cone assembly, wherein the face of the roller cone assembly is free of the plurality of inserts or teeth.

9. The earth-boring tool of claim 1, wherein at least one the at least two protruding ridges includes one or more cutting elements located along a length of the at least one protruding ridge.

10. A method of forming an earth-boring tool comprising:

forming a tool body comprising at least one blade and a pocket defined in the tool body adjacent to the at least one blade, a surface of the pocket defining at least two fixed ridges; and disposing a roller cone assembly into the pocket, wherein each of the at least two ridges is positioned between and within a plane of at least two of at least three longitudinally adjacent inserts or teeth extending from the roller cone assembly.

11. The method of claim 10, wherein at least one ridge of the at least two ridges defines one or more gaps along a length of the at least one ridge.

12. The method of claim 10, wherein disposing the roller cone assembly into the pocket comprises rotatably coupling the roller cone assembly to an arm adjacent to the pocket.

13. The method of claim 10, further comprising:

removing material from at least one ridge of the at least two ridges to define one or more gaps along a length of the at least one ridge.

14. The method of claim 10, further comprising:

removing material from the pocket to define one or more recesses adjacent the at least two ridges.

15. The method of claim 10, wherein disposing the roller cone assembly into the pocket comprises positioning the roller cone assembly such that a first ring of inserts or teeth comprising a first cutting element of the at least three longitudinally adjacent inserts or teeth is positioned on a first side of the at least one ridge and a second ring of inserts or teeth comprising a second cutting element of the at least three longitudinally adjacent inserts or teeth is positioned on a second opposite side of the at least one ridge.

16. An earth-boring tool comprising:

a roller cone assembly configured to rotate relative to a tool body of the earth-boring tool about a longitudinal axis of the roller cone assembly; and two or more fixed ridges extending from the tool body toward a surface of the roller cone assembly, each ridge of the two or more ridges extending between and into a plane of at least two of at least three longitudinally adjacent inserts or teeth extending from the roller cone assembly.

17. The earth-boring tool of claim 16, further comprising at least one recess located between the two or more ridges, the at least one recess configured to increase drag experienced by the roller cone assembly when at least one of the at least three longitudinally adjacent inserts or teeth of the roller cone assembly interfaces with the at least one recess.

18. The earth-boring tool of claim 17, wherein the roller cone assembly comprises one or more bearing elements and at least one seal element configured to prevent debris from contacting the one or more bearing elements, wherein the one or more inserts or teeth of the roller cone assembly are configured to interface with the at least one recess when a longitudinal axis of the roller cone assembly deviates from a principal axis of rotation of the roller cone assembly responsive to a failure of the at least one seal element.

* * * * *